US009516991B2

(12) United States Patent
Aro

(10) Patent No.: US 9,516,991 B2
(45) Date of Patent: Dec. 13, 2016

(54) REMOVABLE DISHWASHER UTENSIL BASKET THAT TRANSFORMS INTO A UTENSIL HOLDER FOR A DRAWER

(71) Applicant: Joseph Aro, Valley Cottage, NY (US)

(72) Inventor: Joseph Aro, Valley Cottage, NY (US)

( * ) Notice: Subject to any disclaimer, the term of this patent is extended or adjusted under 35 U.S.C. 154(b) by 0 days.

(21) Appl. No.: 13/917,813

(22) Filed: Jun. 14, 2013

(65) Prior Publication Data

US 2014/0367387 A1 Dec. 18, 2014

(51) Int. Cl.
*A47L 15/50* (2006.01)
*B65D 6/08* (2006.01)

(52) U.S. Cl.
CPC ..... *A47L 15/502* (2013.01); *B65D 7/14* (2013.01)

(58) Field of Classification Search
CPC ..... A47L 15/50; A47L 15/502; A47L 15/506; B65D 7/14; B65D 7/16; B65D 7/18; B65D 7/20; B65D 5/44; B65D 5/52; B65D 5/5206; B65D 25/24
USPC ..... 220/488, 817–819, 417, 826; 206/45.23
See application file for complete search history.

(56) References Cited

U.S. PATENT DOCUMENTS 939,234 A * 11/1909 Richhorn ..... 206/45.23
5,069,360 A * 12/1991 Dingler et al. ..... 220/501

* cited by examiner

*Primary Examiner* — Andrew Perreault

(57) ABSTRACT

The invention relates to a new and improved dishwasher utensil basket which eliminates the need to empty the utensil basket or tray in a dishwasher, simply transforming that basket or tray into a drawer organizer and placing it into a drawer. This removable utensil basket saves time and effort and is more sanitary as it eliminates the need to touch each and every utensil. It is also inexpensive and simple to manufacture and easy to use.

2 Claims, 4 Drawing Sheets

REMOVABLE DISHWASHER UTENSIL BASKET THAT TRANSFORMS INTO A UTENSIL HOLDER FOR A DRAWER

This application claims priority of U.S. Provisional patent application No. 61/690,446 filed Jun. 26, 2012.

FIELD OF INVENTION

The present invention relates to the field of utensil organizers, and more particularly pertains to a basket which holds and organizes utensils in a dishwasher and when removed from the dishwasher transforms into a basket which holds and organizes utensils in a kitchen cabinet drawer.

BACKGROUND OF THE INVENTION

Utensils used for eating are generally stored in a basket or a tray in the drawer of a kitchen cabinet utensil use, and then after use, unless they are washed by hand, they are placed in a separate basket in an automatic dishwasher which holds and organizes the utensils for cleaning. The clean utensils are removed from the dishwasher, sorted and generally placed into a basket or tray in the drawer of a kitchen cabinet. This is a repetitive and time-consuming chore. It can also be unsanitary, as it is necessary to touch each and every utensil.

An improved device is needed which eliminates much of this repetitive work, a device which eliminates a step in this process and which maintains the utensils in an organized and useful arrangement and is also inexpensive and simple to manufacture and easy to use.

SUMMARY OF INVENTION

It is therefore an object of the present invention to provide a new and improved device which eliminates the need to empty the eating utensils from the utensil basket or tray taken out of a dishwasher, and is also inexpensive and simple to manufacture and easy to use.

It is a further object of the present invention to provide a new and improved device which eliminates the need to empty the utensil basket or tray in a dishwasher, simply transforming that basket or tray into a drawer organizer and placing it into a drawer.

It is further object of the present invention to provide a new and improved device which eliminates the need to empty the utensil basket or tray in a dishwasher, simply transforming that basket or tray into a drawer organizer and pacing it into a drawer with the sanitary advantage. That it is not necessary to touch each and every utensil when moving it from the dishwasher to a drawer.

It is a further object of the present invention to provide a new and improved device which eliminates the need to empty the utensil basket or tray in a dishwasher, simply transforming that basket or tray into a drawer organizer and placing it into a drawer, said basket or tray being manufactured of compatible size and material to be compatible with the baskets or trays provided by commonly available dishwasher manufactures.

BRIEF DESCRIPTION OF THE DRAWINGS

The foregoing and other features of the present invention will be more readily apparent from the following description of the preferred embodiment taken in conjunction with the attached drawings, wherein.

DESCRIPTION OF THE PREFERRED EMBODIMENT

Figure 1:
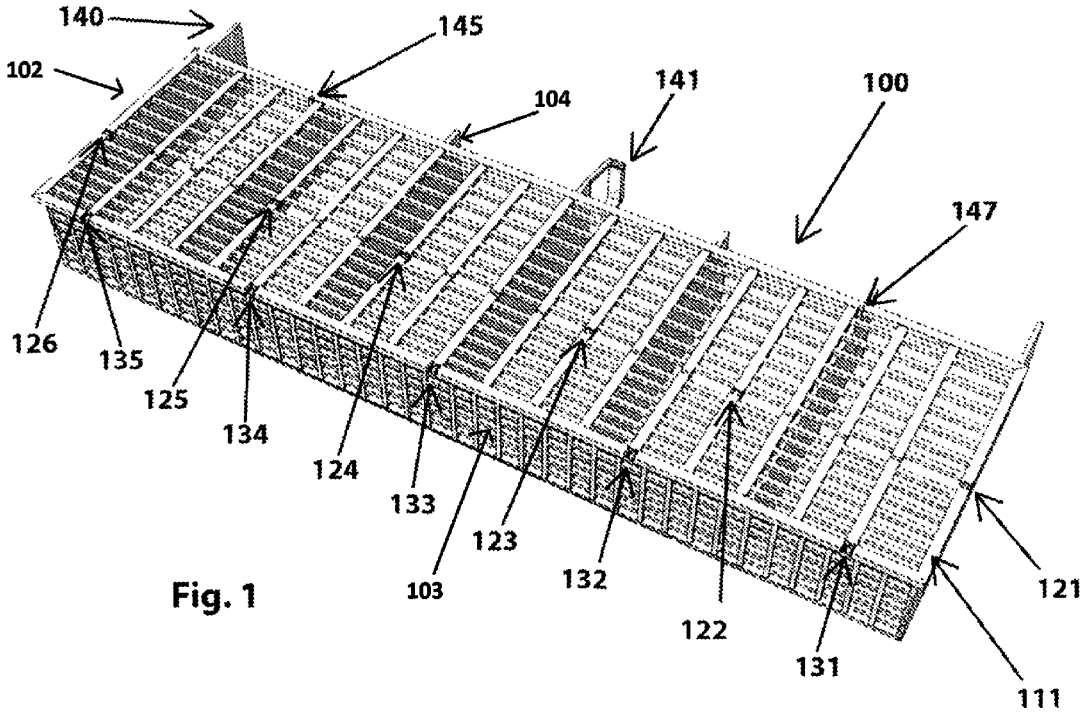
FIG. 1 is a perspective oblique side view of a household dishwasher utensil basket according to one embodiment of the present invention, showing said invention configured for a dishwasher.

Referring now to the figures, FIG. 1 shows the present invention, household dishwasher utensil basket 140 according to one embodiment of said invention comprising a rear wall 100, side walls 102, a front wall 111, a bottom wall 103 and interior panels 104 dividing the basket into compartments for the purpose of holding, organizing and separating eating utensils such as silverware, comprising knives, forks, spoons and the like.

The structure of said front wall 111 includes hinge means 122, 123, 124, 125, 126, 132,133, 134, and 135 which allow said front wall 111 to fold forward and under said dishwasher utensil basket 140, permitting said dishwasher utensil basket 140 to be re-configured and inserted into a drawer without the necessary of removing and sorting said utensils. A clip means 141 holds front wall 111 securely in place when household dishwasher utensil basket 140 is configured for dishwasher use. Hook means 145 and 147 serve as an additional or as an alternative means of removably fastening front wall 111 securely in place.

Figure 2:
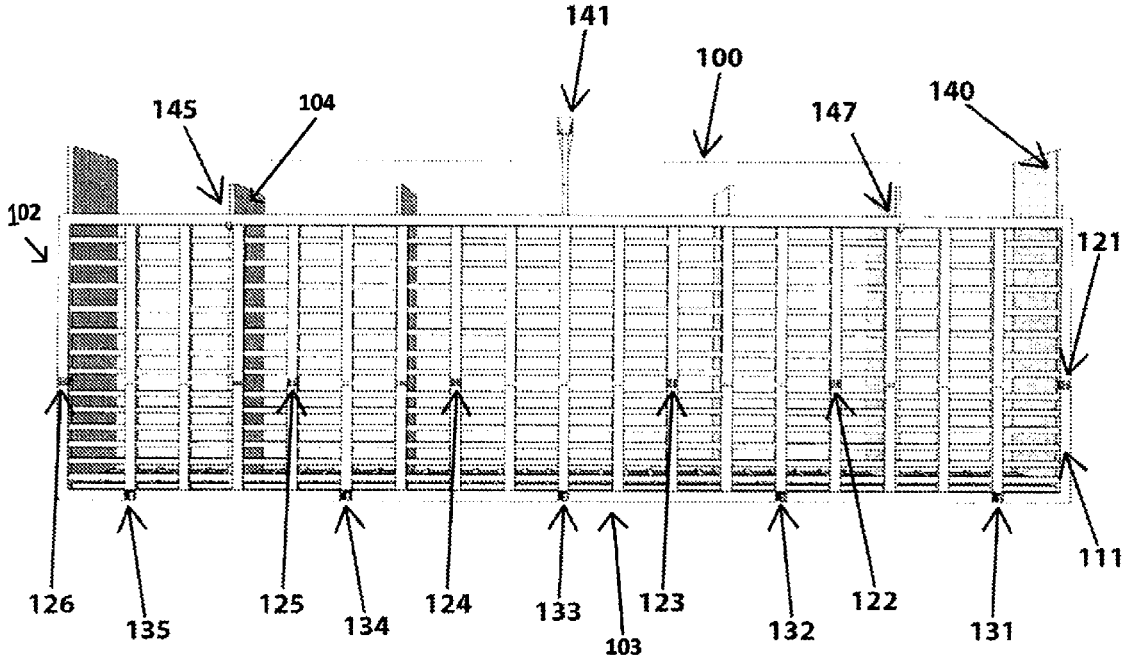
FIG. 2 is a perspective front view of a household dishwasher utensil basket according to one embodiment of the present invention, showing said invention configured for a dishwasher.

Referring to FIG. 2, household dishwasher utensil basket 140 is shown according to one embodiment of said invention comprising a rear wall 100, side walls 102, a front wall 111 and interior panels 104 dividing the basket into compartments for the purpose of holding, organizing, and separating eating utensils such as silverware, comprising knives, forks, spoons and the like.

The structure of said front wall 111 includes hinge means 122, 123, 124, 125, 126, 131, 132, 133, 134 and 135 which allow said front wall 111 to fold forward and under said dishwasher utensil basket 140, permitting said dishwasher utensil basket 140 to be re-configured and inserted into a drawer without the necessity of removing and sorting said utensils. A clip means 141 holds said front wall 111 securely in place when household dishwasher utensil basket 140 is configured for dishwasher use. Hook means 145 and 147 serve as an additional or as an alternative means of removably fastening front wall 111 securely in place.

Figure 3:
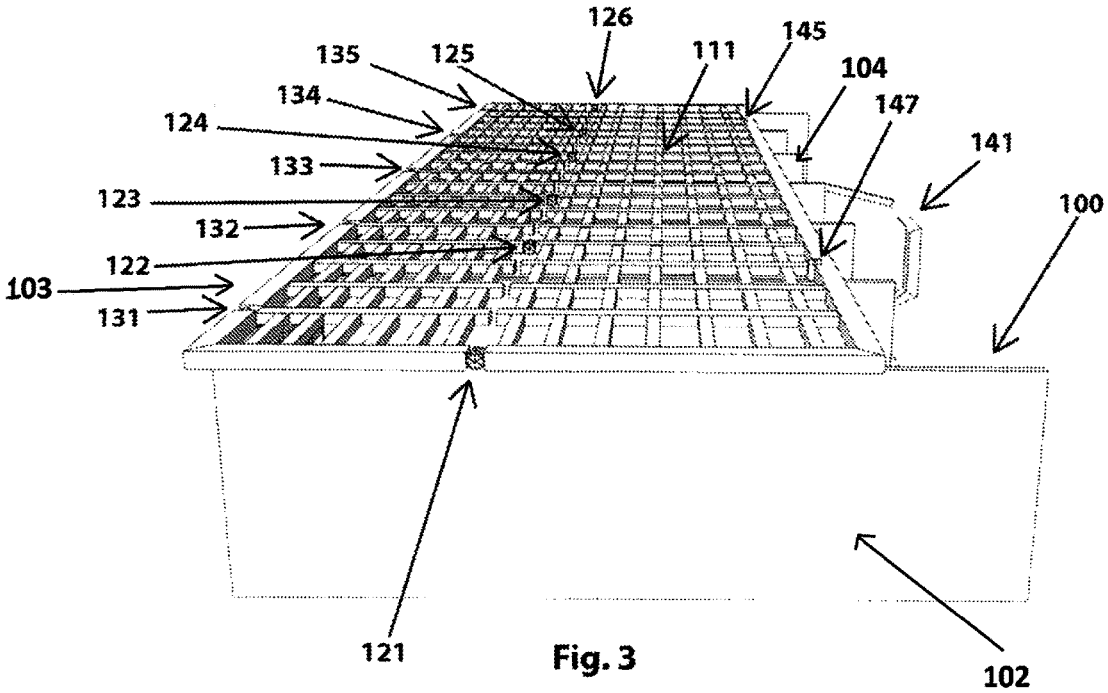
FIG. 3 is a perspective edge view of a household dishwasher utensil basket according to one embodiment of the present invention, showing said invention configured for a dishwasher.
Figure 4:
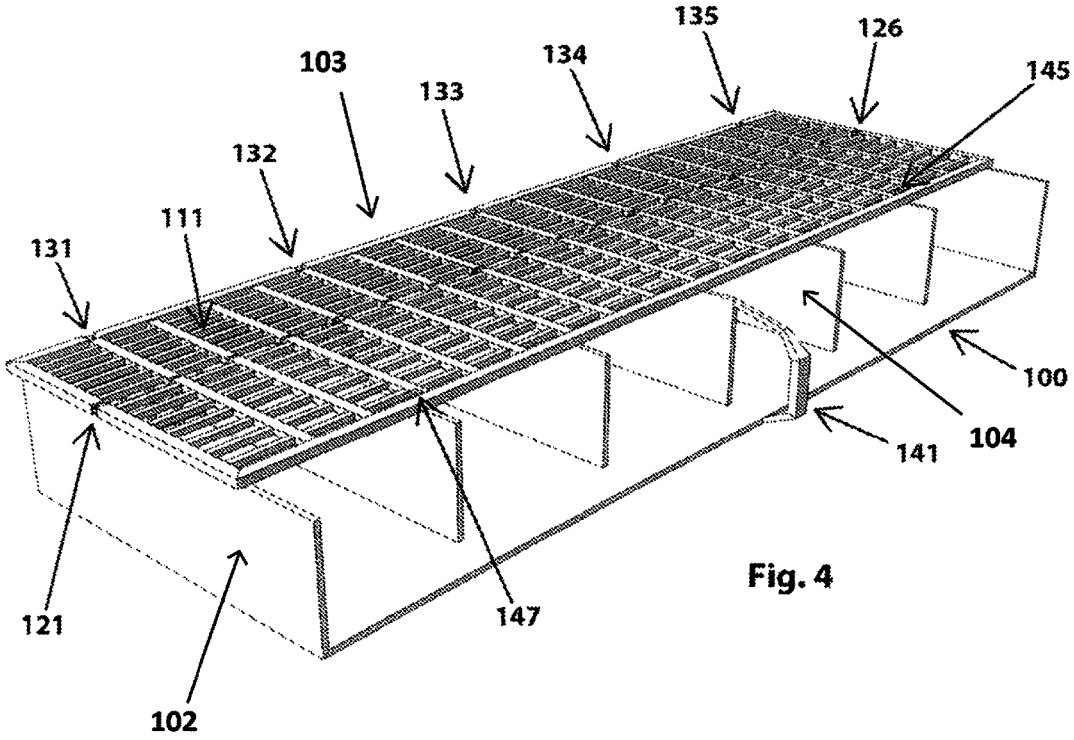
FIG. 4 is a perspective top oblique's view of a household dishwasher utensil basket according to one embodiment of the present invention, showing said invention configured for a dishwasher.

Referring to FIG. 3, household dishwasher utensil basket 140 is shown according to one embodiment of said invention comprising a rear wall 100, side walls 102, a front wall 111 and interior panels 104 dividing the basket into compartments for the purpose of holding, organizing and separating eating utensils such as silverware, comprising knives, forks, spoons and the like;

The structure of said front wall 111 includes hinge means 122, 123, 124, 125, 126, 132, 133, 134 and 135 which allow said front wall 111 to fold forward and under aid dishwasher utensil basket 140, permitting said dishwasher utensil basket 140 to be re-configured and inserted into a drawer without the necessity of removing and sorting said utensils. Referring to FIG. 4 the front panel 111 is folded completely under said utensil basket, which when resting on its rear panel becomes a utensil drawer organizer. A clip means 141 holds said front wall 111 securely in place when household dishwasher utensil basket 140 is configured for dishwasher use. Hook means 145 and 147 serve as an additional or as an alternative means of removably fastening front wall 111 securely in place.

Figure 5:
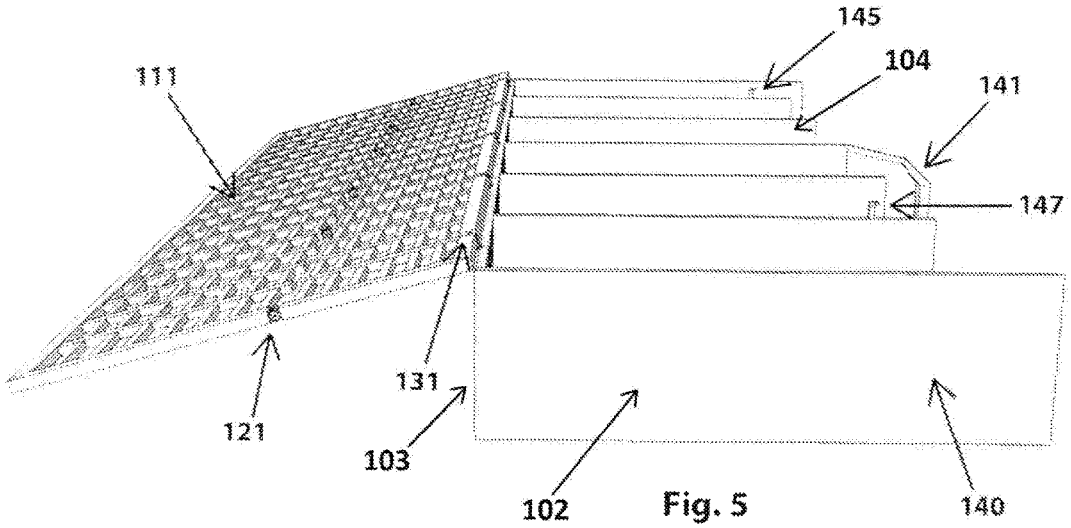
FIG. 5 is a perspective edge view of a household dishwasher utensil basket according to one embodiment of the present invention, showing said invention with front panel 111 folded open.

Referring to FIG. 5, household dishwasher utensil basket 140 is viewed from the side, with clip means 141 released to allow front panel 111 to fold forward on hinge means 121, in the process of transforming to a utensil drawer organizer. Hook means 145 and 147 serve as an additional or as an alternative means of fastening front wall 111 securely in place, and said hook means are shown here in an unhooked position.

Figure 6:
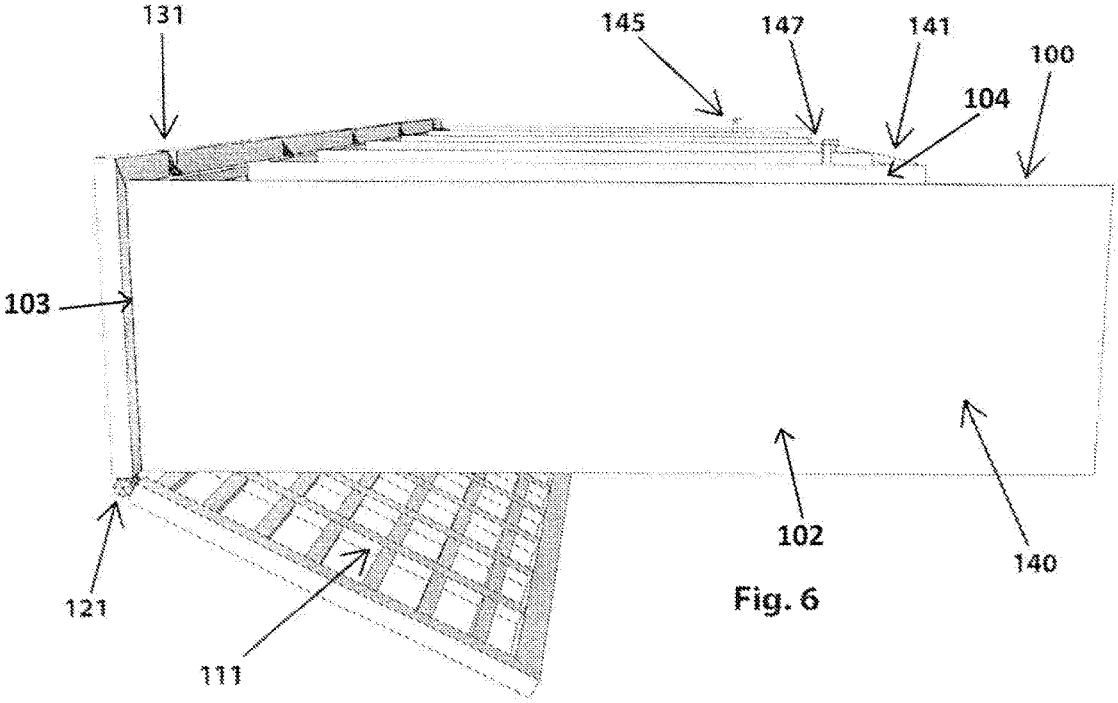
FIG. 6 is a perspective edge view of a household dishwasher utensil basket according to one embodiment of the present invention, showing said invention with front panel 111 folded under the household dishwasher utensil basket 140.

Referring to FIG. 6, household dishwasher utensil basket 140 is viewed from the side, with clip means 141 released to allow front panel 111 to fold forward almost completely on hinge means 121, in the process of transforming to a utensil drawer organizer. Hook means 145 and 147 serve as an additional or as an alternative means of removably fastening front wall 111 securely in place, and said hook means are shown here in an unhooked position.

Figure 7:
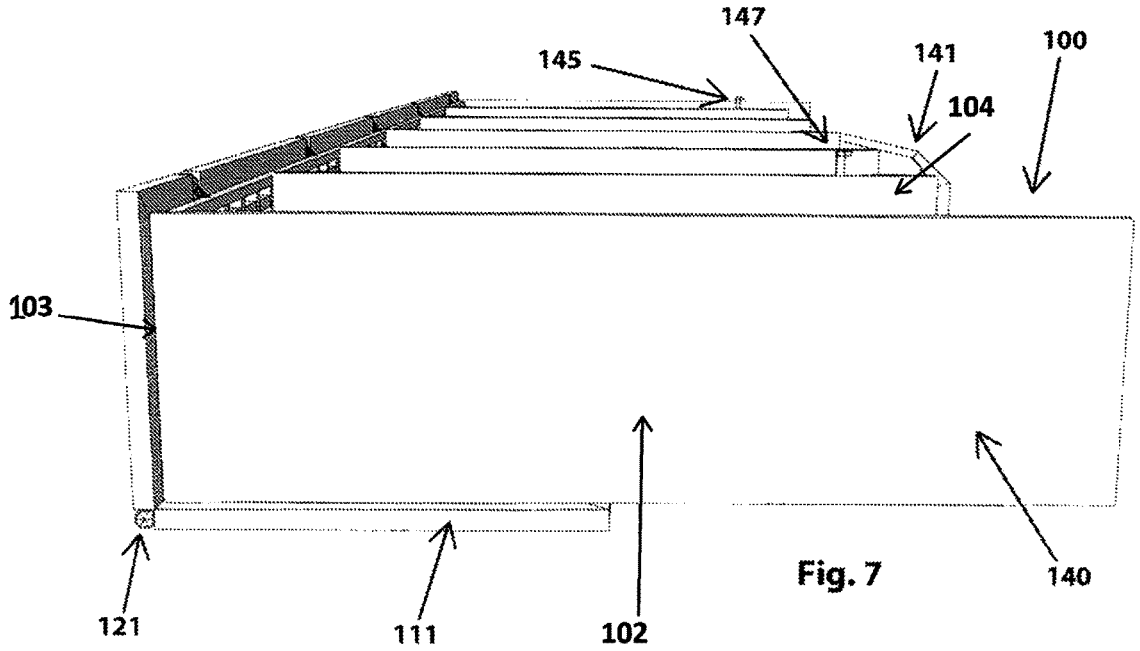
FIG. 7 is a perspective edge view of a household dishwasher utensil basket according to one embodiment of the present invention, showing said invention configured as a drawer insert, with front panel 111 folded under the household dishwasher utensil basket 140.

Referring to FIG. 7, household dishwasher utensil basket 140 is viewed from the side, with clip means 141 released to allow front panel 111 to fold forward completely on hinge means 121, transforming said utensil basket into a utensil drawer organizer. Hook means 145 and 147 serve as an additional or as an alternative means of removable fastening front wall 111 securely in place, and said hook means are shown here in an unhooked position.

Figure 8:
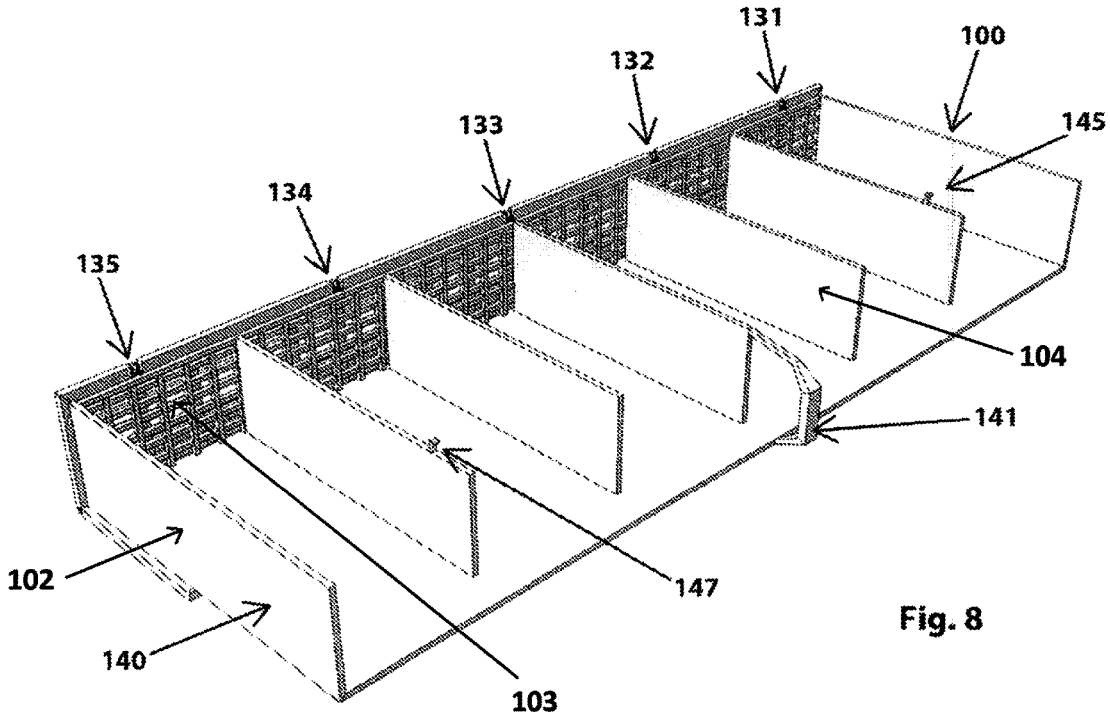
FIG. 8 is a perspective oblique side view of a household dishwasher utensil basket according to one embodiment of the present invention, showing said invention configured as a drawer insert, with front panel 111 folded under the household dishwasher utensil basket 140.

Referring to FIG. 8, household dishwasher utensil basket 140 is viewed obliquely from the side, clip means 141 released to allow with front panel 111 to fold forward completely on hinge means 121, said front panel 111 being flexible as a result of incorporated hinge means 131, 132, 133, 134 and 135, transforming said utensil basket into a utensil drawer organizer. Hook means 145 and 147 serve as an additional or as an alternative means to clip means 141 of removably fastening front wall 111 securely in place, and said hook means are shown here in an unhooked position.

While the invention has been specifically described in connection with certain specific embodiments thereof, it is to be understood that this is by way of illustration and not of limitation, and the scope of the present invention should be constructed as broadly as the prior art will permit.

I claim:

1. A removable dishwasher utensil basket configured to transform into a utensil holder for a drawer, wherein said removable dishwasher utensil basket comprises:

a rear wall comprising means for removably mounting said removable dishwasher utensil basket in said dishwasher;

two side walls comprising a width;

a water-pervious front wall spaced from said rear wall, wherein said water-pervious front wall is divided horizontally into a lower section and an upper section by a plurality of first hinge means mounted between said upper section and said lower section, wherein said lower section is substantially equivalent in height to the width of said side walls, a water-pervious bottom wall connecting said front wall to said rear wall, and said side walls connecting said front, rear and bottom walls;

an interior formed between said bottom, rear, front, and side walls, wherein said interior comprises a plurality of dividers, wherein the plurality of dividers provide clip means and each divider of the plurality of dividers forms a chamber integral with said rear wall and projecting downwardly towards said bottom wall;

a plurality of second hinge means on said lower section of said front wall and said bottom wall, wherein said removable dishwasher utensil basket comprises a first closed position wherein the upper section of said front wall is held in place by said clip means of the plurality of dividers, wherein said removable dishwasher utensil basket comprises a second open position, whereby said plurality of first hinge means permits said lower section of said front wall to pivot downwardly and said front wall pivots from said first closed position adjacent one end of said side walls to said second open position downwardly and away from said end of said side walls to an opposite end of said side walls to provide access to said interior, whereby the plurality of second hinge means and the plurality of first hinge means permits said front wall to pivot to the second open position wherein said lower section of said front wall is parallel to and adjacent to said rear wall and said upper section of said front wall is perpendicular to said bottom wall and said lower section and adjacent to said opposite end of said side walls, whereby in the open second open position, said removable dishwasher utensil basket may be removed from said dishwasher and placed into said drawer.

2. The removable dishwasher utensil basket according to claim 1, wherein said dishwasher utensil basket is comprised of plastic.

* * * * *